United States Patent [19]

Chiu et al.

[11] 4,045,595

[45] Aug. 30, 1977

[54] COATING WOOD SURFACE BY VINYL-MODIFIED LIGNOCELLULOSIC PARTICLES

[75] Inventors: Shui-Tung Chiu, New Westminster; William Melvin Turko, Burnaby, both of Canada

[73] Assignee: The Borden Chemical Company (Canada) Limited, West Hill, Canada

[21] Appl. No.: 650,808

[22] Filed: Jan. 20, 1976

Related U.S. Application Data

[62] Division of Ser. No. 503,640, Sept. 6, 1974, abandoned.

[30] Foreign Application Priority Data

June 13, 1974 Canada ..... 202417

[51] Int. Cl.[2] ..... B05D 1/36; B05D 3/12; B05D 3/02

[52] U.S. Cl. ..... 427/202; 260/17.4 GC; 427/370; 427/393; 428/506; 428/529

[58] Field of Search ..... 427/202, 370, 393; 260/17.4 GC; 428/506, 529

[56] References Cited

U.S. PATENT DOCUMENTS

| | | | |
|---|---|---|---|
| 2,366,025 | 12/1944 | Hall | 427/393 X |
| 3,054,706 | 9/1962 | Glaubert | 427/393 X |
| 3,194,727 | 7/1965 | Adams et al. | 162/168 |
| 3,533,725 | 10/1970 | Bridgeford | 427/393 X |
| 3,563,788 | 2/1971 | Brown et al. | 427/370 |
| 3,687,878 | 8/1972 | Imoto et al. | 260/17.4 GC |
| 3,912,837 | 10/1975 | Pesok et al. | 427/393 |

*Primary Examiner*—Michael R. Lusignan
*Attorney, Agent, or Firm*—Daniel D. Mast; George P. Maskas; George A. Kap

[57] ABSTRACT

Panels are provided with a glossy, tough coating by a method comprising the steps of applying on the panel surface a conventional resin adhesive; spreading thereon vinyl-modified lignocellulosic particles made by polymerization of vinyl monomers on substrate lignocellulosic particles; and subjecting the assembly to heat and pressure. Over a wide range of add-on ratio of vinyl polymer to lignocellulosic particles, coatings can be produced which have neither the solvent sensitivity of the polymer nor the water sensitivity of the cellulose. The novel, esthetically pleasing marbleized appearance is heightened by the use of dyed particles.

9 Claims, 4 Drawing Figures

COATING WOOD SURFACE BY VINYL-MODIFIED LIGNOCELLULOSIC PARTICLES

This is a division of application Ser. No. 503,640, filed Sept. 6, 1974.

BACKGROUND OF THE INVENTION

This invention relates to a novel method for producing a glossy, marbleized, tough, optionally smooth surface on a lignocellulosic panel such as wood, plywood, fiberboard or particleboard.

Untreated surfaces of conventional plywood, fiberboard or particleboard, as indeed those of solid wood itself, are known to have low resistance to abrasion and to be prone to dimensional changes on contact with moisture. Such dimensional changes involve local areas of relative swelling and shrinking, resulting in visual deficiencies which are known as face-checking, grain-raising and the like. The surfaces of particleboards and so-called fiberboards have low decorative value as is also the case with solid wood and plywood when these are made unsightly by knots and knotholes.

Various methods have been used conventionally to provide coatings for panels with the purpose of overcoming some of the aforementioned surface deficiencies. Various types of paints, varnishes, lacquers and the like have been used. In particular among these, amino-modified alkyd resin compositions with solvent and optionally with pigment, have been applied by spraying or roller coating and then oven-treating to evaporate the solvent and cure the polymer to provide a baked enamel finish. Such finishes, however, are usually poor in wearability and in resistance to solvents and chemical stains. The evolution of organic solvents during application causes an air pollution problem. Furthermore, unless the panel surface is first smoothed by a sanding procedure, the surface roughness is "telegraphed" to the surface of the baked enamel finish and the enamel surface has a roughness which is a replica of the roughness on the original panel.

When the conventional oils, paints or varnishes are used, the improvement in appearance is only temporary. Even with up to five successive coats, the barrier to moisture is usually not sufficient to prevent eventual distortion due to swelling and shrinking of the panel.

A type of surfacing known as "overlay" is accomplished by first treating a fibrous web such as paper or cotton fabric with a synthetic polymer of either the thermosetting or thermoplastic type and then laminating the treated web to the substrate panel. Alternatively, thermoplastic films have been used as overlays. When paper treated, exemplarily, with melamine formaldehyde and/or phenol formaldehyde thermosetting resin is used as an overlay, excellent wearability and resistance to stains and solvent are obtained. However, for best results in laminating thermosetting resins, high pressures, up to as high as 1,200 psi, are required, which has the side effect of tending to break down the internal bonds of the panel substrate. Furthermore, to obtain a uniform surface, the platen should be cooled to about 50° C under pressure after each heating cycle.

A fibrous type overlay was disclosed by Bryant (Forest Products Journal 18 (5) :51–58 [1968]) using mechanical wood fibers that were pre-coated with a thermosetting resin. The resin-bound fibers were applied as a mat which had a short duration of pre-curing stability. The direct application of dried phenolic resin powder on the board surface together with wood fibers followed by hot pressing has also been tried; the aforesaid high curing pressure and repeated cooling cycles were still necessary.

Vinyl modified lignocellulosic paper as a top liner for cylinder board is disclosed in Examples 9 of U.S. Pat. Nos. 3,194,727 and 3,395,070. Details of the structure, however, are not set forth.

Corresponding use of thermoplastics in resin paper overlays also has had several disadvantages. The requirement of high alpha-cellulose pulp or paper makes such procedure expensive. The tackiness of polyester-treated paper sheet requires the extra complication of using cellophane separators in handling. Paper overlays made by saturating with acrylic latexes have had deficiencies in heat stability and resistance to organic solvents even when the ratio of acrylic polymer to cellulose was limited to not more than 30%. In order to obtain a smooth, glossy surface, the platen must not be removed after hot pressing until it has been cooled to a temperature below the glass transition temperature of the impregnated thermoplastic polymer.

To the best knowledge of the Applicants, no practicable method has been proposed whereby a particulate composition comprising cellulosic or wood particles merely admixed with thermoplastic polymer particles can be used successfully to prepare a smooth, glossy, tough surface on a wood-based panel and in particular without the necessity of repeated cyclic cooling of the platen to a temperature below the glass transition temperature of the thermoplastic polymer.

SUMMARY OF THE INVENTION

A method of panel surfacing has now been found which permits simplified application conditions as compared to prior methods using either thermosetting or thermoplastic resins. The new method of this invention is cheaper and more practical than prior methods, yet advantageously attains surfaces which have a unique combination of desirable properties including high resistance to abrasion. The glossy and tough surfaces produced have a novel, esthetically pleasing appearance. A variety of surface contours can be achieved depending on the character of the platen surface. With a planar platen, extreme smoothness is attainable.

The method of this invention can be used to upgrade poor grades of substrate wood, being applicable on rough unsanded surfaces without "telegraphing" the roughness.

Briefly stated, the method of this invention comprises applying on the surface of a lignocellulosic panel a conventional resin adhesive, spreading thereon vinyl-modified lignocellulosic particles made by polymerization of ethylenically unsaturated monomers on substrate lignocellulosic particles and subjecting the assembly to heat and pressure to form a coated panel.

The preferred method of hot-pressing uses a platen or caul plate.

The preferred method for preparing said vinyl-modified lignocellulosic particles is a development of the process disclosed in U.S. Pat. 3,083,118 whereby reaction sites in and on said particles are created by deposition of reductant ions like ferrous ion in and/or on the particles. The reductant-treated particles are slurried in water which is substantially free of reductant ions and the subsequent addition of vinyl monomers and free-radical donating initiator results in a vinyl polymerization limited substantially to in situ polymerization on the particles containing the reductant ions. The thus-treated particles are then separated from the aqueous phase and dried.

Coatings are produced by the method of this invention which have neither the solvent sensitivity of the vinyl polymer nor the water sensitivity of the cellulose or lignocellulose. Thus, it has been surprisingly found that such dual resistance to both solvents and water is obtainable over a wide range of add-on ratio of vinyl polymer to lignocellulosic particles. Thus, the weight ratio of vinyl polymer to lignocellulosic particles can be varied over the range from 75% to about 150% without substantial change in the resistance of the finished coating to both solvents and to water.

It is preferred for maximum water resistance that the polymer used to "vinyl-modify" these lignocellulosic particles be present at a 90% to 150% range based upon the bone dry weight of the lignocellulosic particles. That is, the weight of the vinyl would be from slightly less than the weight of the lignocellulose to 1.5 times as much. This range of add-on provides the optimum water resistance, the optimum solvent resistance and the optimum cost for a commercial panel produced according to the practice of the present invention coated with vinyl-modified lignocellulose.

It has been found unexpectedly that when such ratios of vinyl polymer per lignocellulosic particles are used, it is not necessary before removal of the treated panel from the press, to cool below the glass transition temperature of the vinyl polymer or to cool to 50° C. as is required with thermosetting resins. Pressures can conveniently be used in the range of about 200 to 300 psi; thus, there is no danger of breaking down the internal bonds of the panel substrate as is the case when laminates with thermosetting resins are used.

The method of the instant invention thus constitutes a new use for vinyl-modified lignocellulose particles. It has furthermore been found surprisingly that up to about 35% of the vinyl polymer added on to the lignocellulosic particles can be soxhlet extractable without affecting adversely the solvent resistance of the finished surface prepared by the method of this invention.

It is suggested by U.S. Pat. No. 3,083,118 (Column 2, line 45) that wood fibers treated by its method may become thermally moldable and may be ground to produce a molding powder. It is also suggested that polymer-modified wood pulp will be suitable as reinforcing agents in plastics. However, the patent does not contemplate the instant problem of preparing a wood surfacing which is substantially improved over the earlier type of prior art surfacing such as those summarized above. Not only does the patent not consider improving the surface of a wood panel, but when it exemplifies pressing a composition of vinyl-modified pulp (Column 49, line 10) it uses 2,000 psi pressure as compared to the 200–300 psi found to be conveniently sufficient in the instant invention.

A particularly preferred method of carrying out this invention includes a step of dyeing the wet vinyl-modified cellulosic fibers with dyestuffs which can be substantive to either the vinyl or the cellulosic part of the composition or both. Dyeing in this manner results in a particularly pleasing final appearance of the finished coated panel. The marbleized effect which is inherent in the use of the undyed vinyl-modified fibers is heightened by the use of dyes in this manner.

The economical attractiveness of the instant method is enhanced by the fact that cheap grades of lignocellulosic particles can be used as the substrate for producing the vinyl-modified lignocellulosic particles. Many kinds of low-grade waste materials can be used. Although, in some cases, the usefulness is hampered by the presence of substantial amounts of polyphenolic substances such as tannins, in other cases, as described in detail further below, it has surprisingly been found that materials which contain sizeable amounts of polyphenolic substances, as for example Western Hemlock sawdust, can be used effectively.

This invention also relates to the product resulting from the process of the invention, namely a lignocellulosic panel coated with successive layers of, respectively, the dried residue of a prime coat of a conventional resin adhesive and, thereupon, a film comprising coalesced vinyl-modified lignocellulosic particles, said particles being made by polymerization of ethylenically unsaturated monomers on substrate lignocellulosic particles.

The adhesive coated particles are pre-pressed into a panel prior to the panel being coated with vinyl-modified lignocellulose particles.

Figure 1:
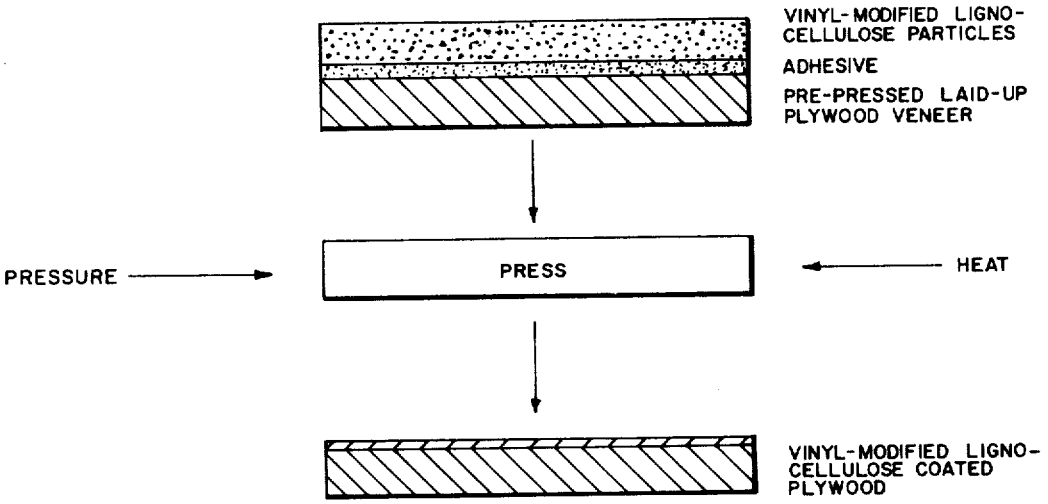
FIG. 1 of the drawings depicts the process of the present invention and how it is employed to manufacture the product of the present invention. A panel is coated with an adhesive and the adhesive is covered with vinylmodified lignocellulose particles. The composite is subjected to heat and pressure which fuses the particles to a film and bonds the film to the panel.
Figure 2:
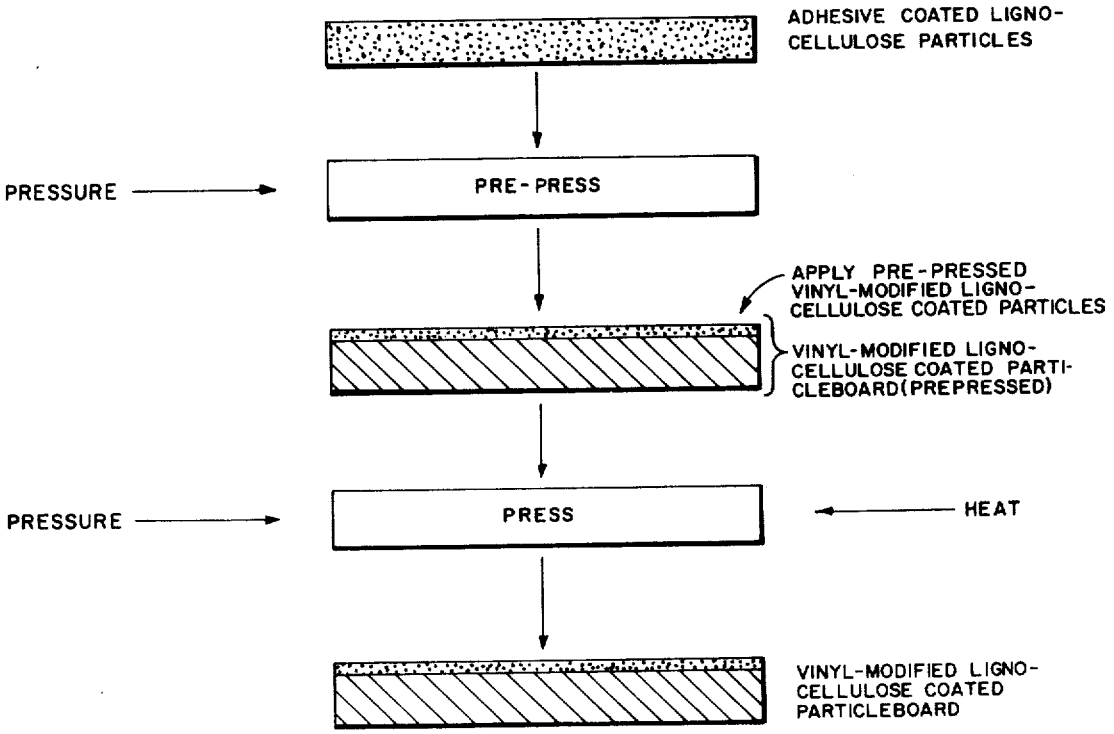
FIG. 2 depicts a variation of FIG. 1 in that adhesive coated particles are employed instead of an adhesive coated panel.
Figure 3:
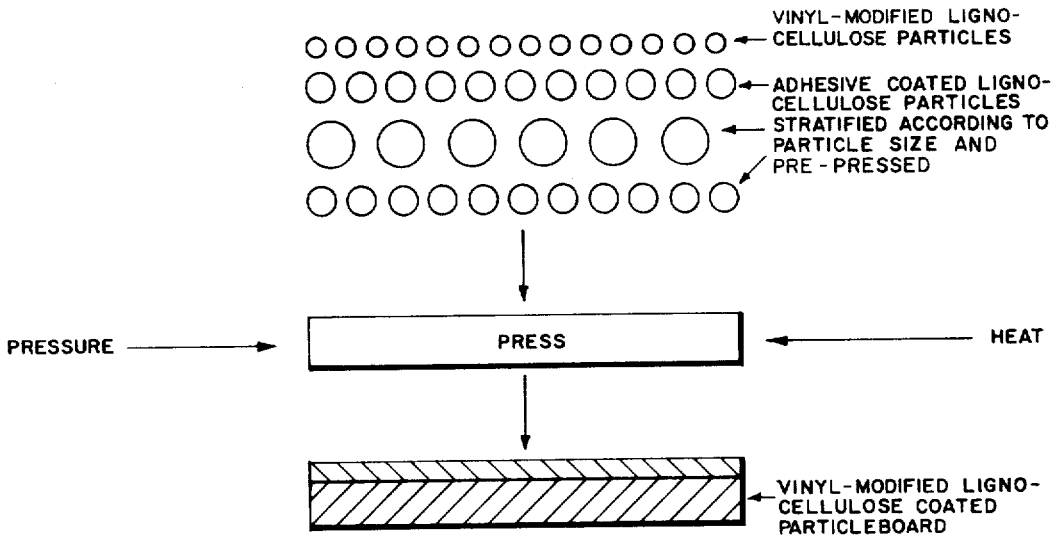
Figure 4:
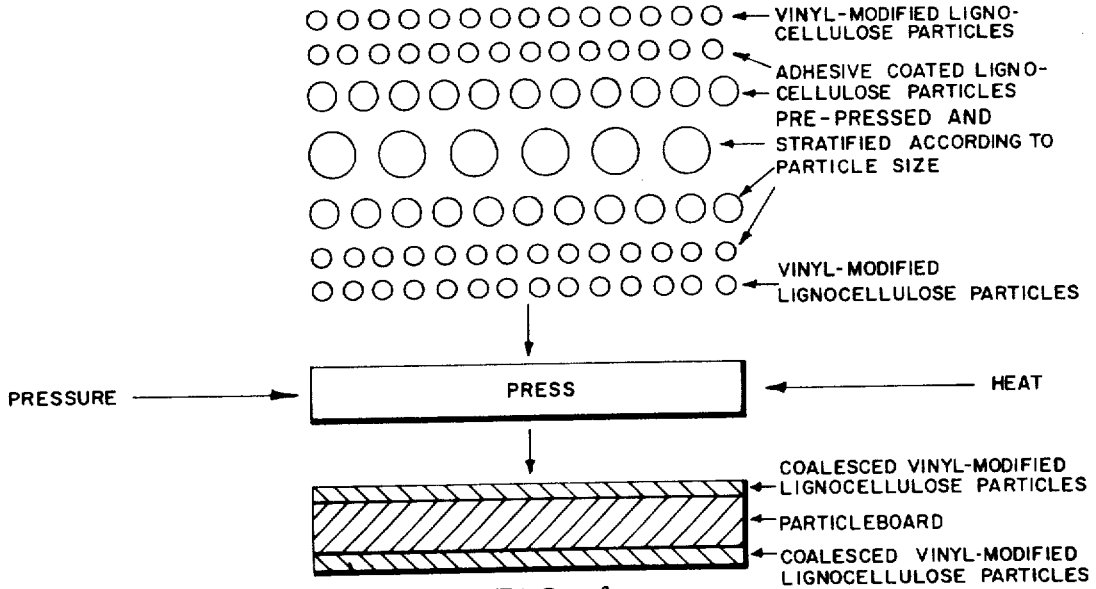

FIGS. 3 and 4 depicts the same basic product as FIG. 2 except that the adhesive coated particles are stratified as to size.

FIG. 4 in addition shows a vinyl-modified lignocellulose particle derived coating on both sides of the panel.

DETAILED DESCRIPTION OF THE INVENTION

The lignocellulosic panel as used in this specification can be wood, plywood, particleboard, or fiberboard. These materials are commonly used in building construction industry, are well known, not critical to the practice of the present invention and will not be described in detail herein.

The term "lignocellulosic", as used in this specification, designates the general class of cellulosic substances which includes not only pure grades of alpha-cellulose but also natural products and by-products containing substantial amounts of lignin and other natural occurring substances besides cellulose.

The vinyl-modified lignocellulosic particles used in the method of this invention are prepared by in situ polymerization of a thermoplastic vinyl polymer in and/or on cellulosic or lignocellulosic substrate particles. As will be evident from the discussion further below, the deposition of vinyl polymer takes place at least partially within the particles and can also take place on the outer surface of the particles; hence expressions like "deposition (or polymerization) on the particles" as used herein are intended to signify "deposition (or polymerization) in and/or on said particles".

Preparation of the vinyl-modified lignocellulosic particles can be carried out by any of several procedures known to the prior art which comprise a step of creating reaction sites on cellulosic material, from which sites vinyl polymerization can be initiated. Such conventional methods have been variously called "graft polymerization", "guest on host polymerization" and the like.

The preferred method for preparing such vinyl modified particles used in this invention is the redox initiated process disclosed in U.S. Pat. Nos. 3,083,118 and 3,395,070. Using this process, the lignocellulosic substrate particles are first slurried in an aqueous solution of suitable reductant cations such as ferrous ions, cuprous ions, chromous ions, manganous ions, titanous ions or the like, whereby a substantial fraction of the reductant ions is absorbed by and/or absorbed on the particles. The particles are then washed to remove excess supernatant reductant ions and reslurried in water substantially free of reductant ions. Then to this aqueous slurry are added the monomer or monomers to be polymerized on the substrate particles, together with sufficient water-soluble free-radical donor to initiate polymerization on reaction with the reductant ions. Reaction is carried out at a suitable temperature (exemplarily at 25°-95° C.) and with agitation, for a time sufficient to effect substantially complete polymerization of the monomers. The treated particles are then separated from the supernatant aqueous phase and dried by any suitable means to a moisture content of about 0.5 to 15% by weight of bone-dry vinyl-modified lignocellulosic particles.

Free radical donors which can be used to effect the vinyl polymerization on lignocellulosic particles include any such donors commonly known to those skilled in the art of polymerization, including hydrogen peroxide, and the persulfates, of the alkali metals and ammonium. Thus, exemplarily, there can be used sodium persulfate, potassium persulfate, ammonium persulfate. The preferred free-radical donor is hydrogen peroxide.

Separation of the vinyl-modified particles from the supernatant water solution can be accomplished by any known method such as filtration, centrifugation and the like. The preferred method is filtration.

While some of the advantages of this invention can be obtained with vinyl-modified particles, having a moisture content of from 0.5 to 15%, it is preferred to control this moisture content to between 2 and 10%, particularly in order to obtain products with high resistance to abrasion. Particles containing from about 3 to 7% moisture by weight of bone-dry particles are most suitable.

Although present Applicants do not wish to be bound by theoretical considerations, it appears quite likely that at least the first stages of such polymerization take place within the non-crystalline amorphous regions of the lignocellulosic particles. It is not completely understood to what extent vinyl polymers originating within or on top of the cellulosic structure are bound to the cellulose by actual covalent bonds. The fact that substantial quantities of the vinyl polymers are not extractable by solvents capable of dissolving the polymers can be attributed either to the formulation of such covalent bonds to the substrate or, alternatively, to the irreversible entrapment of the in situ polymerized vinyl polymers within the cellulose structure. Such entrapment could be traceable to purely steric factors but could also involve associative forces among the respective molecules of vinyl polymer, cellulose and other substances that are present within the amorphous structure of the substrate.

Alternative processes which can be used for making the particles designated herein as a vinyl-modified lignocellulosic particles are suggested by U.S. Pat. Nos. 3,330,787, 3,359,224 and 3,046,078. The first two of these patents disclose preliminary modification of cellulosic materials by treatment with a sulfur compound, exemplarily, ethylene sulfide or carbon disulfide and converting the mercaptan formed into salts of ferrous or like reductant ions, finally proceeding with polymerization of monomer in the additional presence of a free-radical donor. The third of these patents utilizes ceric (IV) ion as the initiator of polymerization. Whereas the first two of these methods are particularly effective with particles having high lignin content, the last of these is not satisfactory in the presence of lignin.

Among other disclosures describing method for preparing vinyl-modified cellulosic particles, U.S. Pat. No. 3,457,198 discloses the use of manganic phosphate as initiator. Various methods have also been used exploiting high energy radiation such as gamma rays or x-rays to initiate the polymerization of vinyl monomers in or on cellulosic substrates.

The substrate lignocellulosic material to be used in carrying out the process of this invention can be any kind of particulate or fibrous lignocellulosic substance capable of sorbing reductant cations in a catalytically active state. A special advantage is that many kinds of low-grade waste materials can be used such as sawdust, wood dust created by sanding the surface of plywood, mill waste, mechanically groundwood pulp, recycled newsprint, miscellaneous type of straw including bagasse, rice and wheat straw, and also the coarse low density fibers commercially available for manufacture of fiberboard. Much of the above such as sanding dust from plywood manufacture creates a significant waste disposal problem, or at least did until the present invention provided a solution to the problem.

It has unexpectedly been found that lignocellulosic substrate materials containing relatively high amounts of lignin are especially suitable for preparing vinyl-modified particles to be used in this invention. Materials high in lignin have a higher ion exchange capacity and are capable of absorbing high amounts of the reductant cation. Accordingly, these materials are capable of accepting higher depositions of the modifying vinyl polymer in a non-solvent-extractable form.

The presence of substantial amounts, exemplarilymore than about 1%, of polyphenolic materials in a lignocellulosic substrate prevents obtainment of a suitable level of catalytic activity, because vinyl monomers add-on polymerization is inhibited and/or retarded. Such polyphenolic materials include tannins and polyphenolic derivatives of lignans, stilbenes, flavonoids and the like.

Certain woods, including Western Hemlock and Western Red Cedar, commonly have undesirably high levels of interfering polyphenolic materials, substantially higher than about 1%. Particulate materials derived from Douglas Fir sometime contains undesirably high amounts of interfering polyphenolics. When it is contemplated to use materials of this type, it should first be ascertained experimentally whether the particular supply of such material is satisfactory, preferably by carrying out a small scale preliminary vinyl modification of a sample of said supply. Alternatively, a sample of the substrate material can be submitted to a suitable procedure of assay as, for example, by carrying out a suitable extraction under conditions standardized to correlate with reactivity of the particular substrate. Means of carrying out such standard extration as exemplarily by hot water, alcohol, acetone, aqueous sodium hydroxide or aqueous sodium carbonate will readily occur to those trained in the art.

Such standardized extraction, as exemplarily by the Soxhlet method, would yield a calibration parameter as a relative estimate of the material's reactivity in the method of this invention. Thus, a particular sample of Western Hemlock might be established to be sufficiently reactive for attaining a particularly desired level of add-on if a standard Soxhlet extraction by methanol yielded no more than about 1% extractables.

It will also occur to those trained in the art that a material which originally contains too high a level of polyphenolic to be acceptable for vinyl modification according to this invention, can be made satisfactory for such purpose by a preliminary extraction with any suitable solvent, preferably water or one of the other extracting media mentioned above for analytical purposes.

Thus, exemplarily, a material containing about 30% lignin and about 5% polyphenolics can be extracted preferably just far enough to remove sufficient polyphenolic, simultaneously losing a minimum of the desirable lignin. Exemplarily, a particulate wood material derived from a "high polyphenolic" Western Red Cedar was steeped one hour in boiling water at 3% consistency (i.e. 3 grams wood per 100 grams water) and found to provide a substrate material satisfactory for vinyl modification by methyl methacrylate; whereas, to obtain successful vinyl modification of the same substrate material by styrene, a more drastic extraction treatment was found to be necessary, namely, by cooking for 3 hours in 3% aqueous sodium hydroxide solution at 100° C., again at about 3% consistency, thus making a semi-chemical pulp.

Among the materials which are particularly suitable substrates for vinyl modification, there are cottonwood, Sitka Spruce and Red Alder. These woods not only normally contain about 25-30% ligneous material, but also characteristically contain advantageously low amounts of polyphenolic materials, usually about less than 1%. Consequently, these low-cost materials can also be used without preliminary extraction.

While highly purified cotton fibers, rayon fibers, cellophane particles and other types of refined particulate material high in alpha cellulose can be used as substrates for vinyl modification for the purpose of this invention, a particularly preferable cheap substrate material is the wet process groundwood pulp of commerce which usually contains substantially less than about 1% of polyphenolic as the result of the leaching which is an inherent part of of the grinding.

While present applicants do not wish to be bound by theoretical considerations, it appears likely that the interfering effects of polyphenolic materials are related to chelation of the reductant cations, either inhibiting the initiation of polymerization or diffusing the formation of latex particles.

As to size of the particles to be used for vinyl modification, these can be varied over a wide range of magnitude, particles in the range of about 45 mesh or less, or groundwood pulp, being particularly suitable.

Ethylenically unsaturated monomers which are capable of polymerizing with themselves and with each other by the free-radical mechanism of vinyl polymerization are legion in the art. Any of these can be selected singly or in combination to make the vinyl-modified lignocellulosic particles used in carrying out this invention. Their selection can be varied within the scope of this invention, according to principles well understood by those skilled in tailormaking polymers, to obtain the benefits of desired combinations of properties such as strength, gloss, glass temperature, coalescence, hardness, abrasion-resistance, water-resistance, dyeability, solvent-resistance and others.

Monomers chosen for vinyl-modification can be aliphatic or aromatic and include alpha-olefins; vinyl and vinylidene halides; styrenes; vinyl esters; alkyl esters of carboxylic acids such as acrylic, methacrylic, itaconic and crotonic acids and the like or dialkyl esters of maleic acid and fumaric acid; acrylonitrile, methacrylonitrile, acrylamide, methacrylamide and others.

An alpha-olefin can, for example, have 2-6 carbon atoms, thus it can be ethylene, propylene, butene-1 or hexane-1. A vinyl halide can be vinyl chloride, vinyl bromide or vinyl fluoride. A vinylidene halide can be vinylidene chloride. A styrene can be styrene itself or vinyl toluene or the like. A vinyl ester can be derived from any carboxylic acid, thus it can be vinyl formate, vinyl acetate, vinyl propionate, vinyl benzoate or vinyl stearate.

An alkyl ester of a carboxylic acid can be any ester of exemplarily acrylic, methacrylic, crotonic, itaconic or aconitic acid or any diester of fumaric or maleic acid, respectively with any straight chain, branched or cyclic alcohol as, for example, methyl alcohol, ethyl alcohol, n-propyl alcohol, isopropyl alcohol, n-butyl alcohol isobutyl alcohol, secondary butyl alcohol, tertiary butyl alcohol, n-amyl alcohol, isoamyl alcohol, tertiary amyl alcohol, n-hexyl alcohol, cyclohexanol, n-octyl alcohol, capryl alcohol, n-decyl alcohol or stearyl alcohol. Thus, exemplarily, an alkyl acrylate can be methyl acrylate, isopropyl acrylate, ethyl acrylate, 2-ethyhexyl acrylate, n-octyl acrylate, butyl acrylate, isobutyl acrylate, decyl acrylate or stearyl acrylate; and a dialkyl ester can be dimethyl maleate, diisopropyl fumarate, diethyl maleate, di(2-ethylhexyl) fumarate, di(n-octyl) maleate, distearyl fumarate, dibutyl fumarate, di(isobutyl) maleate, didecyl fumarate, ethyl decyl fumarate or butyl octyl maleate.

The polymer used to "vinyl modify" the lignocellulosic particles can contain polymerized therein also minor amounts of certain monomers known in the art as "functional monomers" contributing polar affinity or cross-linking characteristics. Such monomers can exemplarily be monomers with carboxy groups such as acrylic acid, methacrylic acid, itaconic acid, aconitic acid, methacrylic acid dimer, crotonic acid, isocrotonic acid, angelic acid, teglic acid, senecioic acid, hexenic acid and the $C_1$ - $C_{10}$ alkyl monoesters of maleic acid and fumaric acid. Such monomers can also be monomers containing a nitrogen moiety such as pyridine, methyl pyridine, N-methyl pyridinium chloride or as aminoethyl acrylate. Examples of cross-linking monomers include N-methylolacrylamide, diacetone acrylamide and hydroxymethyl diacetone acrylamides having from 1 to 5 hydroxymethyls per molecule.

It will be understood by those trained in the art that the use of certain monomers will make possible or in some cases even require, corresponding changes in the polymerization conditions. Thus, for example, when methyl acrylate is a monomer, the temperature of reaction can be controlled by refluxing volatile monomer, while in the case of vinyl chloride, the polymerization vessel can be pressurized.

While proportions of comonomers can be selected to obtain a variety of physical properties, the nature of the monomers and their relative proportions should always be such as to obtain both a desirable range of softening suitable to the hot-pressing conditions intended and also a high degree of hardness in the end product. The cheapness and availability of materials will also be important factors. Monomers which have been found particularly advantageous in regard to all these factors are styrene, methyl methacrylate and acrylonitrile; in the examples to follow these are the monomers chiefly used to illustrate the vinyl modification of lignocellulosic materials used in carrying out this invention.

The adhesive used between the vinyl-modified lignocellulosic particles and the panel surface can be any conventional resin adhesive. Thus, it can be of the thermosetting types prepared by low-advanced condensation of formaldehyde with substances selected from phenol, resorcinol, urea, malamine and the like, either singly or in combination. These phenolic resins can be in liquid, powder or dry sheet form. The adhesive can comprise, wholly or in part, thermoplastic resins such as polyvinyl acetate and copolymers of vinyl acetate with minor amounts of functional monomers having carboxyl groups, amino groups, amide groups and/or hydroxy groups. Such vinyl acetate adhesives can exemplarily be made by emulsion polymerization, optionally in the presence of polyvinyl alcohol, carboxymethyl cellulose or other conventional so-called supporting colloids. It is preferred that the adhesive contain at least about 50% solids. Urea-modified phenol-formaldehyde resols are the preferred type of adhesive.

The adhesive can be applied to the panel surface by any convenient method, including spraying, doctoring, rolling and brushing. The preferred method is spraying.

Likewise, any convenient suitable means can be used to spread the vinyl-modified lignocellulosic particles on top of the adhesive-treated surface. Thus, the particles can be distributed by a blower, they can be metered through a transverse slit or apperture, or they can be applied using a doctor blade.

In general, it is preferred to use the adhesive in an amount just sufficient to bring about a strong non-peeling bond between the final hot-pressed coating and the panel. When no adhesive is used, the coating usually has the deficiency of being easily peelable from the substrate. On the other hand, when relatively large quantities of adhesive are used, there is a tendency for the surface appearance of the finished coating to show irregularities attributable to difficulties in removing the excess water contained in the adhesive. For these reasons, it is preferred to use as adhesive spread in the amount of about between 4 and 9 lbs. per 1000 sq. ft. In particular, it is preferred to use adhesive in the amount about 5.5 to 7.7 lbs. per 1,000 sq. ft. For best results, it is preferred that the adhesive-treated panel be allowed to stand for a short period, say, 5–10 minutes at room temperature to permit partial concentration of the adhesive solids by water evaporation and/or sorption by the wood substrate.

The particles of vinyl-modified lignocellulose are than spread by any suitable means over the adhesive surface. It is preferred to spread these particles evenly in an amount sufficient to form a continuous film on hot-pressing. Accordingly, some of the benefits of the invention can be obtained by spreads varying from about 40 to 150 and more lbs. per 1,000 sq. ft. In general, relatively lower amounts in this range can be used on panels of solid wood or plywood, particularly when knothole free. For coating of particleboard and low-grade plywood types, it is preferred to use higher amounts. It is particularly preferred to use the vinyl-modified lignocellulosic particles in amount between about 65 and 85 lbs. per 1,000 sq. ft.

Hot pressing of the assembly can be carried out in any conventional type of press. The caul plate used can be contoured in designs which give the finished coating an embossed effect, but with a smooth caul plate a particularly pleasing smooth marbleized coating is obtained. Platens or caul plates are conventionally made of stainless steel and can be greased by a high-boiling oil such as a silicone or paraffin oil. A wide range of temperatures can be used for carrying out the hot-pressing of this invention. However, it is usually sufficient to use a temperature which is about 60–70 Centigrade degrees higher than the glass transition temperature of the modifying vinyl polymer. Thus, 165° to 170° C. is a suitable temperature range for pressing assemblies comprising polymethyl methacrylate modifications of wood particles and about 175°–180° C. is a suitable temperature when the particles are modified by polystyrene.

Hot-pressing can conveniently be between about 200–300 psi for a period of about 3–7 minutes in the case of solid wood, plywood and particleboard substrates. When particleboard mat or fiberboard mat is coated, higher temperatures for longer periods of time are preferred, exemplarily, about 4–10 minutes at about 250–350 psi.

An advantage in carrying out the pressing step of the instant invention is that it is not necessary to cool the platen further than to about 30° C. higher than the glass temperature of the modifying vinyl polymer. Thus, about 135° C. is a sufficiently low temperature for removal of the assemblies coated with particles modified by either polymethyl methacrylate or polystyrene, without causing visual or other deficiencies in the nature of the coating. This is a significant improvement over the prior art where thermoplastic polymer coating must be cooled to below the glass temperature before releasing the pressure of the press or where thermosetting coatings must be cooled to 50° C. after each heat cycle. Thus, substantial economics can be achieved by avoiding the conventional heat losses at each cycle in the press.

The product resulting from the process of this invention is a panel coated with successive layers of respectively, the dried residue of a prime coat of a conventional resin adhesive, and thereupon, a film comprising coalesced vinyl-modified lignocellulosic particles, said particles being made by polymerization of ethylenically unsaturated monomers on substrate lignocellulosic particles.

This invention will be further illustrated by description in connection with the following specific examples of the practice of it wherein, as also elsewhere herein, proportions are in parts by weight and percentages are by weight unless stated otherwise.

In the following examples the impact resistance was measured using a Model B100 dual impact tester manufactured by the Paul N. Gardner Company. The tester was equipped with a one inch diameter indentor at a four pound weight loading. The reading was taken from the minimum height from which the coating surface cracked.

The abrasion resistance was measured using a Teledyne Taber, Model 503 abraser equipped with a pair of CS-17 calibrase wheels. A 1,000 gram load and 1,000 revolutions were used. Weight loss was determined by the sample weight difference before and after the 1,000 revolution test. Mesh, refers to U.S. Sieve size, or opening per linear inch. For example, a 35 mesh would refer to a National Bureau of Standards Ser. No. 35 screen having a 0.29 mm diameter wire and each hole size being 0.5 mm square.

EXAMPLE 1

An aqueous slurry of Hemlock groundwood pulp was prepared by steeping 28.6 parts of pulp containing 186% moisture and corresponding to 10 parts on a bone-dry basis, in 540 parts of distilled water at room temperature, 25° C. There was then added 3.5 parts of ferrous ammonium sulfate, $Fe(NH_4)_2(SO_4)_2.6H_2O$, with agitation. The pH was adjusted to 4.9 by addition of an aqueous 0.1 normal sodium hydroxide solution and agitation was continued for ten minutes.

The pulp thus treated with ferrous ion was filtered and thoroughly washed free of excess ferrous ion using 300 parts of distilled water. The pulp was then reslurried into 400 parts of distilled water contained in a three-necked flask equipped with agitation, thermometer and reflux condenser. The pH was 4.8. There was then added 1.5 parts of 33% aqueous hydrogen peroxide and 13.9 parts of methyl methacrylate monomer containing 15 ppm of 4-tert-butyl-pyrocatechol. With agitation, the slurry was heated to 80° C. and kept at the temperature for one hour.

The treated pulp was filtered and washed with distilled water. The washed residue was colored by mixing homogeneously with 50 parts of water containing 2% Irgalite Red CPV 3 Paste, a water dispersible organic pigment supplied by Ciba-Geigy Canada, Ltd. The excess dye solution was filtered off and the pulp residue was oven dried (100° C.) to about 10% moisture content. This product has an "add on" equal to 130% polymethyl methacrylate based on the groundwood bone-dry weight. Hereafter, it is referred to as 130% polymethyl methacrylate modified groundwood pulp.

Five plies of spruce veneer (1 × 1 foot) were assembled in the conventional manner of plywood manufacture, spreading both sides of the second and fourth plies with phenolic resin which was prepared by following the glue mixing instruction of Cascophen F-19 (W8-38) of Borden Chemicals (Canada) Ltd., at 55 pounds per 1,000 square feet of double glueline. The laid-up plywood panel was then pre-pressed under 150 psi for three minutes at room temperature (25° C.).

After pre-pressing, the laid-up face veneer was sprayed with 0.006 lbs. of a urea-modified phenol formaldehyde resol. The resin adhesive was made by condensing 33.2 parts by weight of 46.5% concentration formaldehyde aqueous solution and 23.4 parts of 90.0% concentration phenol in the presence of 7.0 parts of 50% concentration sodium hydroxide and 26.4 parts of water. The formaldehyde to phenol molar ratio is 2.3.

The solution was heated to 80° C. with stirring and held at that temperature for three hours until the resin viscosity at 25° C. was 230 cps. At that point, 10 parts by weight of urea was added and continuously stirred for another 10 minutes. The resin temperature was then cooled to 15° C. and removed to storage. Hereafter, the resin is referred to as W180.

The urea-modified phenol formaldehyde resin (W180) sprayed face veneer was then spread with 0.0771 pounds of the polymethyl methacrylate modified and pigmented pulp by using a steam-heated laboratory press. The entire assembly was then hot-pressed under a smooth stainless steel caul plate at 170° C. and 230 psi for 5 minutes. Before the pressure was released, the hot-platen was cooled down to 135° C. The hot-pressing simultaneously cured the plywood glueline and developed a smooth, glossy, and tough surface.

EXAMPLE 2

Sample of pre-pressed particleboard substrates (5 × 5 × 0.5 inches) were prepared in a conventional manner from a conventional wood furnish and about 5% based upon the dry weight of the furnish of the phenolic resin (W180) prepared according to Example 1.

Douglas fir wood particles were modified by styrene monomer following the procedure described below, generally following the procedure of Example 1. At room temperature (25° C.) 17.27 parts of Douglas fir wood particles having a particle size of 20–35 mesh and a moisture content of 15.1% were steeped in 300 parts of distilled water containing 1.8 parts of ferrous ammonium sulfate, $Fe(NH_4)_2(SO_4)_2.6H_2O$. The pH was adjusted to 5.6 by adding 0.1 normal sodium hydroxide solution. After agitating for 5 minutes, the excess aqueous solution was filtered and then thoroughly washed with 300 parts of distilled water to remove excess free ferrous ions.

The wood particles thus treated were reslurried into 380 parts of distilled water contained in a three-necked flask equipped with agitator, thermometer and reflux condenser. The pH of the wood and water mixture was 5.3. To the flask was added 15 parts of styrene monomer containing 15 ppm 4-tert.-butyl pyrocatechol stabilizer. The mixture was agitated with 1.5 parts of 33% hydrogen peroxide was then added. With agitation, the mixture was heated to 90° C. and kept at that temperature for four hours.

At the end of the reaction, the styrene-treated wood particles were filtered and washed with distilled water. Then the modified wood particles were dyed with 50 parts of 0.5% Lissamine Scarlet solution. After removal of the excess dye solution by filtration, the wood particles were oven-dried to 4.7% moisture content.

On one of these pre-pressed particleboards, there was spread an amount of polystyrene modified Douglas fir wood particles sufficient to deposit 0.19 lbs. of modified wood particles per square foot. The thus coated board was covered with a smooth-surface caul plate and hot-pressed in a Carver Laboratory hot press at 170°–180° C. under a pressure of 300 psi for 8 minutes. A smooth and tough surface was produced.

The surface of the finished panel was subjected to an abrasion test using a Teledyne, Taber Abraser, Model 503, with wheel C-17 with a total loading of 1,000 grams. After 1,000 revolutions, the test indicated that a weight loss of only 214 mg as compared to a loss of 330 mg obtained in a corresponding control test of a particleboard sample which did not have the surface coating of this example. Hereafter, the test is referred as Taber abrasion resistance.

EXAMPLE 3

Onto 14.49 parts of wood furnishes containing 5.5% moisture were sprayed 2.47 parts of Example 1 described urea-modified phenol formaldehyde resin (W180) by using a spray gun and rotated blender. The wood furnishes used was a commercial mix of pine, Douglas fir, hemlock, spruce and larch and used to commercially manufacture particleboard. The size distribution was as follows:

| Particle Size | % by Wt. |
|---|---|
| >20 mesh | 52.7 |
| 20–35 mesh | 29.6 |
| <35 mesh | 17.7 |

An 11 inch by 11 inch mat about one inch thick was formed from 8.40 parts of the resin sprayed wood furnish and pre-pressed under 20 psi for two minutes. On top of the mat was spread with 0.43 parts of the 130% polymethyl methacrylate modified groundwood pulp which was prepared as described in Example 1.

The coated mat was then covered with a ferrotype plate which had been pre-sprayed with 5% silicone oil, a mold release agent supplied by IDI Electric Canada, Ltd. The assembly was hot-pressed under the following conditions:

| | |
|---|---|
| Temperature | 173° C |
| Pressure | 260 psi |
| Time | 8 minutes |
| Closing Time | 2.5 minutes |

After hot-pressing, the pressure was released without cooling down the press.

The board formed had a thickness of 0.45 inches, a density of 0.85 grams per cubic centimeter, a coating thickness of 16 mil, and abrasion resistance of 35 mg per 1,000 cycles and an impact strength of 24 inch-pounds.

The impact resistance was measured using a Model B100 dual range impact tester manufactured by the Paul N. Garnder Company. The tester was equipped with a one-inch diameter indentor at a four pound weight loading. The reading was taken from the minimum height from which the coating surface cracked. Hereafter, the test is referred as impact strength.

EXAMPLE 4

This example describes a coating on a three-layer particleboard mat. The wood furnishes sprayed with 8.28 parts of the urea-modified phenol formaldehye resin (W180) were prepared as described in Example 3.

| Particle Size | % by Wt. |
|---|---|
| >20 mesh | 52.7 |
| 20–35 mesh | 29.6 |
| <35 mesh | 17.7 |

A 20-mesh screen was used to separate 8.28 parts of adhesive binder treated wood furnish into two different particle size groups. The wood furnishes retained on the 20 mesh screen were used as the core of a mat. The wood furnishes not retained were divided into two equal quantities which were distributed equally on both sides of the core.

An 11 inch by 11 inch mat about one inch thick was formed from the adhesive treated wood furnish and prepressed under 20 psi for two minutes. On top of the mat was spread 0.43 parts of the groundwood pulp having 130% add-on polymethyl methacrylate.

The coated mat was then covered with a ferrotype plate which had been pre-sprayed with 5% silicone oil, a mold release agent supplied by IDI Electric Canada, Ltd. The assembly was hot pressed under the following conditions:

| | |
|---|---|
| Temperature | 173° C |
| Pressure | 260 psi |
| Time | 8 minutes |
| Closing Time | 2.5 minutes |

After hot pressing, the pressure was released without cooling down the press.

The board formed had a thickness of 0.45 inches, a density of 0.93 grams per cubic centimeter, a coating thickness of 16 mil. and Taber abrasion resistance of 65 mg per 1,000 cycles and an impact strength of 28 inch-pounds.

EXAMPLE 5

This example illustrates coating a multi-layer particleboard mat. The particleboard wood furnishes and procedure of blending urea-modified phenolic resin (W180) were described in Example 3.

A quantity of 8.88 parts of the urea-modified phenol formaldehyde resol (W180) sprayed wood furnishes were screened first by a 20-mesh screen and then a 35 mesh screen.

| Particle Size | Weight (Parts) |
|---|---|
| >20 mesh | 5.45 |
| 20–35 mesh | 2.23 |
| <35 mesh | 1.16 |

As illustrated in FIG. 4, an eleven inch square mat about one inch thick was formed by first spreading 0.43 parts of the groundwood pulp having 130% add-on polymethyl methacrylate on a ferrotype plate, then one-half of the wood furnish less than 35 mesh was spread evenly on top of the treated pulp, then one-half of the wood furnish having a particle size of 20–35 mesh and all of the larger than 20 mesh were spread in layers. The layering was then reversed with the remainder of the 20–35 mesh and less than 35 mesh being applied. The mat was pre-pressed and 0.43 parts of pulp containing polymethyl methacrylate add-on was then applied.

The coated mat was then covered with a ferrotype plate which had been pre-sprayed with 5% silicone oil, a mold release agent supplied by IDI Electric Canada, Ltd. The assembly was hot-pressed under the following conditions:

| | |
|---|---|
| Temperature | 173° C |
| Pressure | 260 psi |
| Time | 8 minutes |
| Closing Time | 2.5 minutes |

After hot-pressing, the pressure was released without cooling down the press.

The board formed had a thickness of 0.46 inches, a density of 0.87 grams per cubic centimeter, a coating thickness of 11 mil, Taber abrasion resistance of 57 mg per 1,000 cycles and an impact strength of 20 inch-pounds.

EXAMPLE 6

This example exemplifies an embossed finish coating of particleboard by using a plate with a designed surface.

A 117% polymethyl methacrylate modified Western Hemlock groundwood pulp was prepared following the procedure described in Example 1. At the end of polymerization, excess water was filtered off and 0.03 parts of DuPont Fast Green WGD, a water soluble organic pigment, was mixed homogeneously with one part (bone-dry basis) of the polymethyl methacrylate modified pulp. The pigment treated modified pulp was then oven-dried (100° C.) to 8% moisture content.

A 128% polymethyl methacrylate modified Western Hemlock groundwood pulp was also prepared following the procedure described in Example 1. At the end of add-on polymerization, excess water was filtered off. One part (bone-dry basis) of the modified pulp was homogeneously mixed with 5 parts water containing 0.025 parts DuPont Fast Blue BWD, a water soluble organic pigment. The excess color solution was removed by filtration and the modified pulp was oven-dried (100° C.) to 2% moisture content.

The urea-modified phenol formaldehyde resin (W180) sprayed particleboard wood furnishes and the procedure of forming multi-layer mat were described in Example 5.

A quantity of 9.62 parts of the urea-modified phenol-formaldehyde sprayed wood furnishes were screened first by a 20-mesh screen and then a 35-mesh screen:

| Particle Size | Weight (Parts) |
|---|---|
| >20 mesh | 5.44 |
| 20–35 mesh | 2.88 |
| <35 mesh | 1.30 |

Similar to as described in Example 5, an eleven inch square mat about one inch thick was formed by first spreading 0.50 parts of the above prepared 128% polymethyl methacrylate modified pulp on a V-shaped embossed stainless steel plate which had been pre-sprayed with 5% silicone oil. One-half of the wood furnishes less than 35-mesh was spread evenly on top of the modified pulp, then one-half of the wood furnish having a particle size of 20–35 mesh and all of the wood furnishes larger than 20-mesh were spread in layers. The layering was then reversed with the remainder of the 20–35 mesh and less than 35-mesh wood furnishes being applied. The multi-layer mat was pre-pressed under 20 psi for two minutes; and 0.35 parts of the above prepared 117% polymethyl methacrylate add-on pulp was then applied.

The coated mat was then covered with another ferrotype plate which had also been pre-sprayed with 5% silicone oil. The assembly was hot-pressed under the following conditions:

| | |
|---|---|
| Temperature | 173° C |
| Pressure | 260 psi |
| Time | 8 minutes |
| Closing Time | 2.5 minutes |

After hot-pressing, the pressure was released without cooling down the press.

The formed board, as a result, had an embossed design on one face replicating the platen surface, while the other face was flat and smooth.

EXAMPLE 7

This example illustrates an embossed finish coating of plywood by using a plate with a designed surface.

A 130% polymethyl methacrylate modified and pigmented groundwood pulp was prepared by the procedure of Example 1. The modified pulp was oven-dried to a 5% moisture content and ground to a powder using a Ramony Laboratory Mill.

A one foot square and 0.6 inch thick Spruce unsanded plywood was first sprayed with 0.0066 pounds of the urea-modified phenol formaldehyde resin (W180) adhesive which was described in Example 1. Then 0.11 pounds of the above mentioned 130% polymethyl methacrylate modified pulp powder was spread evenly on the board surface. The coated surface was covered with a V-shaped engraved stainless steel plate, which had been pre-sprayed with 5% silicone oil.

The assembly was hot-pressed under 230 psi at 170° C. for 5 minutes. Before pressure was released, the platen was cooled down to 135° C.

The coated plywood surface showed the replica of the embossed platen surface.

EXAMPLE 8

An unsanded Douglas fir plywood sample 6 inches square and one-half inch thick was coated with 0.012 pounds of the urea-modified phenolic resin (W180) adhesive described in Example 1. A coating of 0.06 pounds, 20–35 mesh modified Douglas fir particles containing 79% add-on of polystyrene was spread evenly on the surface. The particles were prepared according to the procedure of Example 2 and dyed with Lissamine Scarlet. The assembly was then hot-pressed under a smooth stainless steel caul plate under a pressure of 250 psi at 175° C. for five minutes. The hot platen was cooled down to 130° C. before pressure was released.

A smooth and tough surface was produced. The Taber abrasion resistance was 93 mg per 1,000 cycles.

EXAMPLE 9

An unsanded Spruce plywood sample 6 inches square and one-half inch thick was coated with 0.012 pounds of the urea-modified phenolic resin (W180) adhesive described in Example 1. A coating of 0.09 pounds of 20–35 mesh modified Douglas fir particles containing 79% add-on of polystyrene was spread evenly on the surface. The particles were prepared according to the procedure of Example 2 and were dyed with Lissamine Scarlet. The hot-pressing was then conducted under a smooth stainless steel caul plate under a pressure of 250 psi at 175° C. for five minutes. The hot platen was cooled down to 130° C. before pressure was released.

A smooth and tough surface was produced. The Taber abrasion resistance was 157 mg per 1,000 cycles.

EXAMPLE 10

An unsanded Hemlock plywood sample 6 inches square and one-half inch thick was coated with 0.022 pounds of the urea-modified phenolic resin (W180) adhesive described in Example 1. A coating of 0.06 pounds of less than 35-mesh modified spruce wood particles was then applied. The particles were prepared according to the procedure of Example 2 contained 97% add-on polystyrene and were dyed with calcocid Brilliant Blue, FFR Ex, supplied by Cyanamid of Canada. The assembly was then hot-pressed under a smooth stainless steel caul plate under a pressure of 250 psi at 175° C. for five minutes. The hot platen was cooled down to 135° C. before pressure was released.

A smooth and tough surface was produced. The Taber abrasion resistance was 93 mg per 1,000 cycles.

EXAMPLE 11

An unsanded Spruce plywood sample 6 inches square and one-half inch thick was coated with 0.012 pounds of the urea-modified phenolic resin (W180) adhesive described in Example 1. A coating of 0.06 pounds of 20–35 mesh modified spruce wood particles were spread evenly on the surface. The particles were prepared according to the procedure of Example 2, contained 90% add-on of polystyrene and were dyed with methylene blue. The assembly as then hot-pressed under a smooth stainless steel caul plate under a pressure of 250 psi at 175° C. for five minutes. The hot platen was cooled down to 135° C. before pressure was released.

A smooth and tough surface was produced. The Taber abrasion resistance was 186 mg per 1,000 cycles.

EXAMPLE 12

An unsanded Spruce plywood sample 6 inches square and one-half inch thick was coated with 0.012 pounds of the urea-modified phenolic resin (W180) adhesive described in Example 1. A coating of 0.06 pounds of 20–35 mesh modified spruce wood particles was spread evenly on the surface. The particles were prepared according to the procedure of Example 2, contained 90% add-on of polystyrene and were dyed with methylene blue. The assembly was then hot-pressed under a smooth stainless steel caul plate under a pressure of 250 psi at 175° C. for five minutes. The hot platen was cooled down to 135° C. before pressure was released.

A smooth and tough surface was produced. The Taber abrasion resistance was 31 mg per 1,000 cycles.

EXAMPLE 13

An unsanded Douglas fir sample 6 inches square and one-half inch thick was coated with 0.018 pounds of the urea-modified phenolic resin (W180) adhesive described in Example 1. A coating of 0.06 pounds of less than 35 mesh Douglas fir wood particles containing 69% add-on of polymethyl methacrylate was spread evenly on the adhesive coated surface. The particles were prepared according to the procedure of Example 1 and were dyed with Safranin-O. The assembly was then hot pressed under a smooth stainless steel cual plate under a pressure of 250 psi at 175° C. for five minutes. The hot platen was cooled down to 135° C. before the pressure was released.

A smooth and glossy surface was produced. The Taber abrasion resistance index was 213 mg per 1,000 cycles.

EXAMPLE 14

An unsanded Western Hemlock sample 6 inches square and one-half inch thick was coated with 0.018 pounds of the urea-modified phenolic resin (W180) adhesive described in Example 1. A coating of 0.09 pounds of 20–35 mesh modified Western Hemlock particles containing 74% add-on of polymethyl methacrylate was spread evenly on the adhesive coated surface. The particles were prepared according to the procedure of Example 1. The assembly was then hot pressed under a smooth stainless steel caul plate under a pressure of 250 psi at 175° C. for five minutes. The hot platen was cooled down to 135° C. before the pressure was released.

A smooth, glossy, tough, marbleized surface was produced. The Taber abrasion resistance index was 135 mg per 1,000 cycles.

EXAMPLE 15

An unsanded Spruce plywood sample 6 inches square and one-half inch thick was coated with 0.18 pounds of the urea-modified phenolic resin (W180) adhesive described in Example 1. A coating of 0.06 pounds of 20–35 mesh modified spruce wood particles containing 90% add-on of polymethyl methacrylate was spread evenly on the adhesive coated surface. The particles were prepared according to the procedure of Example 1 and were dyed with Chlorazol Black E. The assembly was then hot-pressed under a smooth stainless steel caul plate under a pressure of 250 psi at 175° C. for five minutes. The hot platen was cooled down to 135° C. before the pressure was released.

A smooth, glossy, tough, marbleized surface was produced. The Taber abrasion resistance was 172 mg per 1,000 cycles.

EXAMPLE 16

An unsanded Douglas fir plywood sample 6 inches square and one-half inch thick was coated with 0.18 pounds of the urea-modified phenolic resin (W180) adhesive described in Example 1. A coating of 0.09 pounds of modified cottonwood groundwood pulp containing 101% add-on the polymethyl methacrylate was spread evenly on the adhesive coated surface. The particles were prepared according to the procedure of Example 1 and were dyed with malachite green. The assembly was then hot-pressed under a smooth stainless steel caul plate under a pressure of 250 psi at 155° C. for nine minutes. The hot platen was cooled down to 135° C. before the pressure was released.

A smooth, glossy, tough, marbleized surface was produced. The Taber abrasion resistance index was 86 mg per 1,000 cycles.

EXAMPLE 17

An unsanded Western Hemlock plywood sample 6 inches square and one-half inch thick was coated with 0.022 pounds of the urea-modified phenolic resin (W180) adhesive described in Example 1. A coating of 0.09 pounds of modified cottonwood groundwood pulp containing 101% add-on of polymethyl methacrylate was spread evenly on the adhesive coated surface. The particles were prepared according to the procedure of Example 1 and were dyed with Malachite green. The assembly was then hot-pressed under a smooth stainless steel caul plate under a pressure of 250 psi at 165° C. for five minutes. The hot platen was cooled down to 135° C. before the pressure was released.

A smooth, glossy, tough, marbleized surface was produced. The Taber resistance index was 88 mg per 1,000 cycles.

EXAMPLE 18

An unsanded spruce plywood sample 6 inches square and one-half inch thick was coated with 0.022 pounds of the urea-modified phenolic resin adhesive described in Example 1. A coating of 0.09 pounds of modified cottonwood groundwood pulp containing 101% add-on of polymethyl methacrylate was spread evenly on the adhesive coated surface. The particles were prepared according to the procedure of Example 1 and were dyed with Malachite Green. The assembly was then hot-pressed under a smooth stainless steel caul plate under a pressure of 250 psi at 165° C. for five minutes. The hot platen was cooled down to 130° C. before the pressure was released.

A smooth, glossy, tough, marbleized surface was produced. The Taber abrasion resistance index was 104 mg per 1,000 cycles.

EXAMPLE 19

An unsanded Western Hemlock plywood sample 6 inches square and one-half inch thick was coated with 0.022 pounds of the urea-modified phenolic resin (W180) adhesive described in Example 1. A coating of 0.09 pounds of modified cottonwood groundwood pulp containing 263% add-on of polymethyl methacrylate was spread evenly on the adhesive coated surface. The particles were prepared according to the procedure of Example 1 and were dyed with Safranin-O. The assembly was then hot-pressed under a smooth stainless steel caul plate under a pressure of 240 psi at 150° C. for five minutes. The hot platen was cooled down to 130° C. before the pressure was released.

A smooth, glossy, tough, marbleized surface was produced. The Taber abrasion resistance was 67 mg per 1,000 cycles.

EXAMPLE 20

An unsanded Western Hemlock plywood sample 6 inches square and one-half inch thick was coated with 0.018 pounds of the urea-modified phenolic resin (W180) adhesive described in Example 1. A coating of 0.06 pounds of modified cottonwood groundwood pulp containing 263% add-on of polymethyl methacrylate was spread evenly on the surface. The particles were prepared according to the procedure of Example 1 and were dyed with Safranin-O. The assembly was then hot-pressed under a smooth stainless steel caul plate under a pressure of 250 psi at 150° C. for ten minutes. The hot platen was cooled down to 130° C. before the pressure was released.

A smooth, glossy, tough, marbleized surface was produced. The Taber abrasion resistance was 55 mg per 1,000 cycles.

All the coated panels of Example 8 through 20 were submitted to acid, alkali and solvent resistance tests. Excellent resistance to acid, alkali, ethanol and acetone was exhibited by all coatings using modified wood samples having 70–100% add-on. When the samples containing the high (263%) add-on polymethyl methacrylate was used, the resultant surface was visually deteriorated and softened under the influence of soaking in acetone.

All the plywood samples of these examples were found to have excellent resistance to the standard accelerated water submersion tests. There was no delamination of the surface coatings from plywood substrate after three cycles of 10 minutes in boiling water followed by 10 minutes soaking in cooled water.

EXAMPLE 21

This example illustrates the usefulness of the coating of this invention in improving the appearance and serviceability of low grade plywood. A 1 × 1 foot sample fo five-ply unsanded low grade plywood having a rough surface and many knotholes was first treated with a paste of conventional inorganic paste caulking material and cured by drying overnight. The paste was Cascopatch RC-40-31A available from Borden Chemical Canada, Ltd.

The plywood sample was then sprayed with 0.006 pounds of the urea-modified phenolic resin (W180) adhesive as described in Example 1.

There was then spread thereon 0.077 pounds of polymethyl methacrylate modified hemlock groundwood pulp containing 10% moisture and dyed with Methylene Blue. The add-on of polymethyl methacrylate was 130% based on bone-dry weight of pulp. The plywood surface was covered with a smooth stainless steel caul plate and hot-pressed at 170° C. under 230 psi for 5 minutes. Before pressure was released, the hot platen was cooled down to 135° C. The coated plywood surface had the appearance of a high grade of plywood, being smooth and glossy, marbleized and attractively revealing wood grain.

EXAMPLE 22

This example illustrates coating plywood with a groundwood pulp modified by a comonomer of styrene and acrylonitrile.

An aqueous slurry of a commercial refiner groundwood pulp mix of Douglas fir and Western Hemlock was prepared by steeping 98.33 parts of pulp containing 883.3% moisture and corresponding to 10 parts on a bone-dry basis in 300 parts of tap water at room temperature, 25° C. There was then added 1.8 parts of ferrous ammonium sulfate, $Fe(NH_4)_2(SO_4)_2.6H_2O$ with agitation. The pH was 4.6. The mixture was steeped for 15 minutes. The ferrous ion treated pulp was filtered and thoroughly washed free of excess ion using 300 parts of tap water. The pulp was then reslurried into 400 parts of tap water contained in a three-necked flask equipped with agitator, thermometer and reflux condenser. The pH of the pulp slurry was 4.3. A 16 part of comonomer, mixture of 10.4 parts styrene and 5.6 parts of acrylonitrile (65% styrene and 35% acrylonitrile by weight) was then added with agitation. Then 1.3 parts of 33% aqueous hydrogen peroxide was added. With agitation, the mixture was heated to 80° C. and kept at that temperature for three hours.

The comonomer modified pulp was filtered and washed with tap water. The modified pulp was colored by homogeneously mixing with 50 parts of water containing 1% Halopont Violet NM, supplied by DuPont Canada, Ltd. The excess pigment solution was filtered off and the pulp was oven dried (100° C.) to 1% moisture content. This product had an add-on equal to 145% on the bone-dry pulp basis. Hereafter, it is referred to as 145% styrene-acrylonitrile comonomer modified pulp.

A sanded Douglas fir plywood sample of one foot square and one-half inch thick was sprayed with 0.0066 pounds of the urea-modified phenolic resin (W180) adhesive which had been described in Example 1. A quantity of 0.0771 pounds of the groundwood pulp containing 145% add-on of styrene and acrylonitrile was spread evenly on the surface.

The coated plywood surface was then covered with a ferrotype plate which had been pre-sprayed with 5% silicone oil, a mold release agent. The assembly was hot-pressed under a pressure of 230 psi at 170° C. for 5 minutes. The hot platen was then cooled down to 130° C. before the pressure was released.

The coating thickness was 16 mil, and Taber abrasion resistance was 72 mg per 1,000 cycles.

EXAMPLE 23

An unsanded Douglas fir plywood sample of one foot square and one-half inch thick was sprayed with 0.0066 pounds urea-modified phenol formaldehyde resin (W180) adhesive and then spread with 0.0771 pounds of the styrene and acrylonitrile comonomer modified groundwood pulp which was prepared as described in Example 22.

The coated plywood was covered with a ferrotype plate which had been pre-sprayed with 5% silicone oil. The assembly was hot pressed under a pressure of 250 psi at 170° C. for 5 minutes. The hot platen was then cooled down to 130° C. before the pressure was released.

The coating thickness was 13 mil and Taber abrasion resistance was 84 mg per 1,000 cycles.

EXAMPLE 24

A sanded commercial particleboard sample one foot square and one-half inch thick was sprayed with 0.0066 pounds urea-modified phenol formaldehyde resin (W180) adhesive and then spread with 0.0771 pounds of the styrene and acrylonitrile modified groundwood pulp prepared as described in Example 22.

The coated particleboard was covered with a ferrotype plate which had been pre-sprayed with 5% silicone oil. The assembly was hot-pressed under a pressure of 225 psi at 170° C. for 7 minutes. Before the pressure was released, the hot platen was cooled down to 130° C.

The finished coating thickness was 17 mil, and Taber Abrasion resistance was 65 mg per 1,000 cycles.

What is claimed is:

1. A method for producing a coating on a lignocellulose based panel board, which comprises the steps of applying on the panel board surface a conventional resin adhesive; spreading thereon vinyl-modified lignocellulosic particles made by a free-radical donor initiated polymerization of ethylenically unsaturated monomers on substrate lignocellulosic particles to form a thermoplastic coating; and subjecting the coated panel board assembly to heat and pressure sufficient to soften and spread said thermoplastic coating and thereby form a thin, hard, integral surface coating in situ on said panel board.

2. The method of claim 1 wherein the conventional resin adhesive is applied in amount just sufficient to bring about a strong non-peeling bond between the final hot-pressed coating and the wood-based panel, and wherein the vinyl-modified lignocellulosic particles are evenly spread in amount sufficient to form a continuous film during hot pressing.

3. The method of claim 1 wherein the lignocellulose-based panel board is particleboard and said assembly is subjected to a pressure of about 250-300 psi for about 4-10 minutes at a temperature of about 60-70 degrees Centigrade higher than the glass transition temperature of the modifying vinyl polymer.

4. The method of claim 1 wherein the lignocellulosic particles are wet-processed groundwood pulp and wherein the monomer is selected from the group consisting of styrene, methyl methacrylate, acrylonitrile and their mixtures.

5. The method of claim 1 comprising also a step of dyeing the wet vinyl-modified lignocellulosic particles with substantive dyestuff.

6. The method of claim 1 wherein the lignocellulose-based panel board is solid wood or plywood and said assembly is subjected to a pressure of about 200-300 psi for about 3–7 minutes at a temperature of about 60-70 degrees Centigrade higher than the glass temperature of the modifying vinyl polymer.

7. Method for producing an improved and decorative surface on a panel board including the steps of:

providing an already formed wood panel board;

applying a resin adhesive to at least one major surface of said panel board;

allowing the adhesive to partially dry;

forming vinyl-modified lignocellulosic particles by a redox initiated polymerization of an aqueous slurry of lignocellulosic particles and vinyl monomer;

filtering the vinyl-modified lignocellulosic particles and then drying to provide particles having from 3–7% moisture by weight of said particles;

applying a thermoplastic coating of said vinyl-modified lignocellulosic particles over said resin adhesive; and pressing and heating the coated panel to form a thin, continuous film of coalesced vinyl-modified lignocellulosic particles on the surface of said panel board.

8. The process of claim 7 wherein the adhesive is a 50% solids urea-modified phenolic resin adhesive applied at from 4 to 9 pounds per 1000 square feet of panel board, and polymethyl methacrylate modified pulp fibers are applied at from 40 to 150 pounds of pulp fibers per 1000 square feet of panel board, and the composite is pressed at a pressure of from 200–300 psi and at a temperature of from 165° to 170° C. to form a thermoplastic film of said pulp fibers.

9. The process of claim 8 wherein said polymethyl methacrylate modified pulp fibers are dyed before being spread on the surface of said panel board to provide a colored panel board.

* * * * *